US011415942B2

(12) United States Patent
Zaugg

(10) Patent No.: US 11,415,942 B2
(45) Date of Patent: Aug. 16, 2022

(54) TIMEPIECE TRANSMISSION MECHANISM WITH REDUCED COUPLING FORCE

(71) Applicant: Montres Breguet S.A., L'Abbaye (CH)

(72) Inventor: Alain Zaugg, Le Sentier (CH)

(73) Assignee: Montres Breguet S.A., L'Abbaye (FR)

( * ) Notice: Subject to any disclaimer, the term of this patent is extended or adjusted under 35 U.S.C. 154(b) by 801 days.

(21) Appl. No.: 16/360,498

(22) Filed: Mar. 21, 2019

(65) Prior Publication Data

US 2019/0294110 A1 Sep. 26, 2019

(30) Foreign Application Priority Data

Mar. 26, 2018 (EP) ..... 18163966

(51) Int. Cl.
*G04B 13/02* (2006.01)
*G04F 7/08* (2006.01)
(Continued)

(52) U.S. Cl.
CPC ..... *G04B 19/02* (2013.01); *G04B 3/06* (2013.01); *G04B 13/007* (2013.01);
(Continued)

(58) Field of Classification Search
CPC ... G04F 7/0861; G04F 7/0871; G04B 27/065; G04B 13/007; G04B 3/06; G04B 19/02; G04B 13/008; G04B 13/02
See application file for complete search history.

(56) References Cited

U.S. PATENT DOCUMENTS 7,965,584 B2 * 6/2011 Papi ..... G04B 21/12 368/243
8,337,077 B2 * 12/2012 Giacobino ..... G04B 11/006 368/147

(Continued)

FOREIGN PATENT DOCUMENTS

CH 216001 7/1941
EP 3 021 175 A1 5/2016

OTHER PUBLICATIONS

European Search Report dated Nov. 5, 2018 in European Application 18163966.7 filed on Mar. 26, 2018 (with English translation ofcategories of Cited Documents).

(Continued)

*Primary Examiner* — Sean Kayes
(74) *Attorney, Agent, or Firm* — Oblon, McClelland, Maier & Neustadt, L.L.P.

(57) ABSTRACT

A timepiece transmission mechanism, with a differential mechanism with inputs or outputs including a first wheel set cooperating with a first train and a second wheel set cooperating with a second train, this differential mechanism kinematically connecting the first wheel set and second wheel set in the coupling position, and separating them in the uncoupling position, the first wheel set carrying a planet wheel set which meshes with a toothing of an arbor integral in rotation with the second wheel set, and with a crown-wheel forming another input or output of the differential mechanism, which includes control means arranged to lock or release the crown-wheel to perform the coupling or the uncoupling function, depending on the position given to the control means by a selector arranged to cooperate with an actuator of a timepiece movement, or to be operated by a user.

20 Claims, 3 Drawing Sheets

(51) Int. Cl.

| | |
|---|---|
| ***G04B 19/02*** | (2006.01) |
| ***G04B 13/00*** | (2006.01) |
| ***G04B 27/06*** | (2006.01) |
| ***G04B 3/06*** | (2006.01) |

(52) U.S. Cl.
CPC ..... *G04B 13/008* (2013.01); *G04B 13/02* (2013.01); *G04B 27/065* (2013.01); *G04F 7/0861* (2013.01); *G04F 7/0871* (2013.01)

(56) References Cited

U.S. PATENT DOCUMENTS

| | | | | |
|---|---|---|---|---|
| 8,864,368 | B2 * | 10/2014 | Dubois | G04B 9/025 368/211 |
| 9,477,206 | B2 * | 10/2016 | Philippine | G04F 7/0842 |
| 2016/0132022 | A1 * | 5/2016 | Goeller | G04B 3/006 368/206 |
| 2016/0139567 | A1 | 5/2016 | Philippine | |

OTHER PUBLICATIONS

Combined Chinese Office Action and Search Report dated Aug. 18, 2020 in corresponding Chinese Patent Application No. 201910227997.7 (with English Translation of Category of Cited Documents), 6 pages.

* cited by examiner 100
20
21
22
1
6
3
10
5
40
7
50
30
31
ON
OFF
OFF
OFF
F1
F2
F3

100
1000
100
500

30
31
50
21
20
29
22
B
A
28
10
1
91
2
5
4
100
3
93
6
96
B
A

TIMEPIECE TRANSMISSION MECHANISM WITH REDUCED COUPLING FORCE

CROSS-REFERENCE TO RELATED APPLICATION

This application claims priority to European Patent Application No. 18163966.7 filed on Mar. 26, 2018, the entire disclosure of which is hereby incorporated herein by reference.

FIELD OF THE INVENTION

The invention concerns a timepiece transmission mechanism, arranged to be integrated in a timepiece movement and including at least one differential mechanism including at least one planet wheel mounted for free rotation and at least three main wheel sets forming the inputs or outputs of said differential mechanism, which three main wheel sets are formed by a frame, a first wheel set arranged to cooperate with a first train, and a second wheel set arranged to cooperate with a second train, only one of said three main wheel sets carrying at least one said planet wheel permanently meshing with the other two main wheel sets, either directly or through at least one intermediate wheel set which permanently meshes with one of said other two main wheel sets or which is integral in rotation with one of said other two main wheel sets, said differential mechanism being able to kinematically connect said first wheel set and said second wheel set in a coupling position, and to kinematically uncouple them in an uncoupling position.

The invention also concerns a timepiece movement including at least one such transmission mechanism.

The invention also concerns a timepiece, in particular a watch, including at least one such movement, and/or at including least one such transmission mechanism.

The invention also concerns a timepiece movement including at least one such transmission mechanism.

The invention concerns the field of mechanical timepiece mechanisms.

BACKGROUND OF THE INVENTION

In horology, the coupling function has often been used:

In a winding and time setting mechanism, for example, the sliding pinion performs this coupling and uncoupling function when the crown moves from position T1 (winding) to position T2 (time setting), and vice versa when the crown returns from position T2 to position T1. In this particular case, there is dual coupling, since the winding mechanism is uncoupled when the time setting mechanism is coupled and vice versa.

In a chronograph mechanism, the Start/Stop function is performed by a coupling (Start) and uncoupling (Stop) mechanism. The chronograph coupling may be radial through engagement/disengagement of the toothings of two wheels that are moved together/apart. It may also be axial or vertical, when two wheels that pivot coaxially are held in contact by a spring or held apart by a fork system.

These complex mechanisms incorporate expensive, fragile components which cannot transmit high torque.

Furthermore, these known coupling mechanisms require substantial force to operate the coupling, which means that some components have unnecessarily large dimensions.

European Patent Application No EP3021175A1 in the name of AUDESMARS PIGUET discloses a rattrapante or splits-seconds device with an epicycloidal train for timepieces, especially for chronograph watches, the device comprising a split-seconds pinion carrying a split-seconds hand and mounted for free rotation about an axis of rotation of the timepiece. The device includes a differential comprising an input wheel able to be kinematically connected to an energy source of the timepiece, a first output wheel kinematically connected to the input wheel by at least one planet wheel and meshing with the split-seconds pinion, a second output wheel kinematically connected to the input wheel by said at least one planet wheel, and a control lever for locking either the first output wheel or the second output wheel, such that whichever of the first output wheel and second output wheel is released by the control lever is drivable by the input wheel when the latter is kinematically connected to the timepiece energy source, thus making it possible to lock or respectively release the split-seconds hand.

SUMMARY OF THE INVENTION

The invention proposes to offer an alternative solution to the aforecited mechanisms, which limits the number of components that move to perform the coupling and uncoupling functions.

To this end, the invention concerns a timepiece transmission mechanism according to claim 1.

The invention also concerns a timepiece movement including at least one such transmission mechanism.

The invention also concerns a timepiece, in particular a watch, including at least one such movement, and/or at including least one such transmission mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
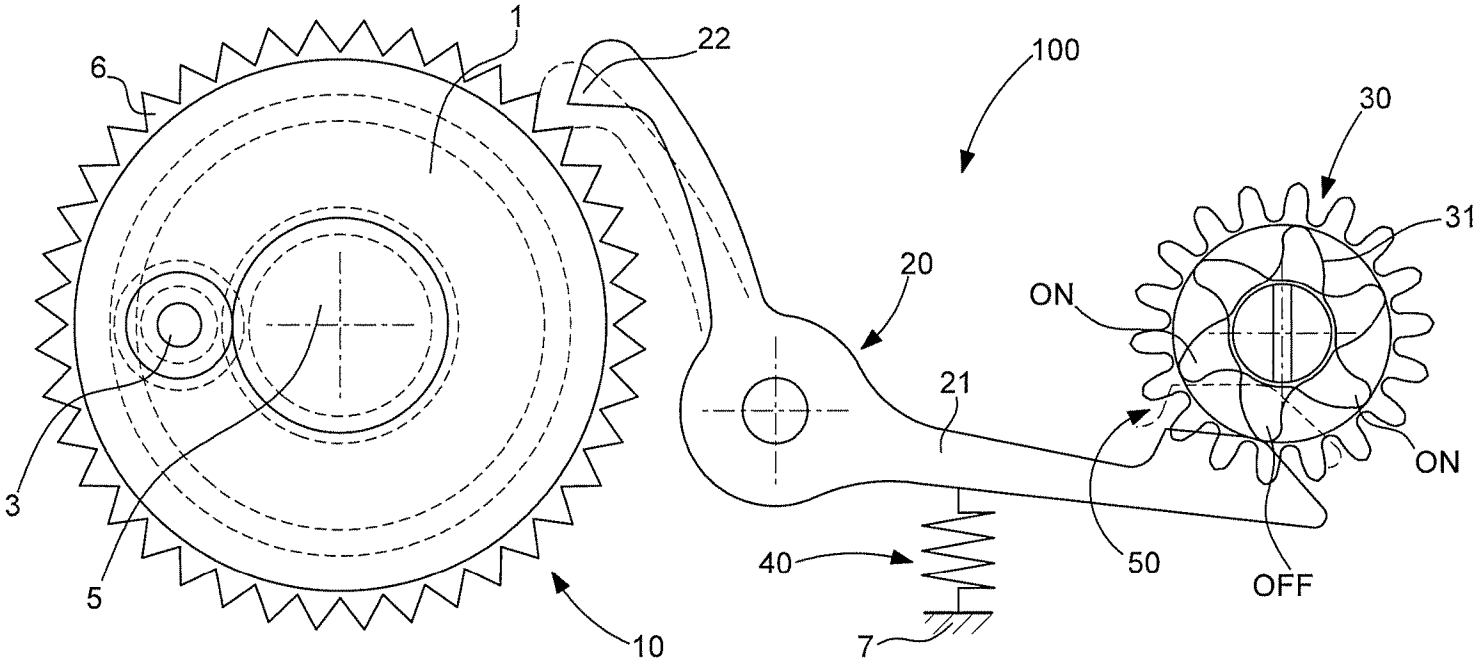
FIG. 1 shows a schematic, plan view of a single coupling mechanism according to the invention.

The invention concerns a timepiece transmission mechanism 100, arranged to be integrated in a timepiece movement 500 and including at least one differential mechanism 10.

This differential mechanism 10 includes at least one planet wheel 3, which is mounted for free rotation, and at least three main wheel sets forming inputs or outputs of differential mechanism 10. These three main wheel sets are formed by a frame 60, a first wheel set 1 arranged to cooperate with a first train, and a second wheel set 2 arranged to cooperate with a second train. Only one of these three main wheel sets carries at least one such planet wheel 3 permanently meshing with the other two main wheel sets, either directly, or through at least one intermediate wheel set 8, which permanently meshes with one of the other two main wheel sets, or which is integral in rotation with one of the other two main wheel sets.

This differential mechanism 10 is able to kinematically connect first wheel set 1 and second wheel set 2 in a coupling position, and to kinematically uncouple them in an uncoupling position.

According to the invention, transmission mechanism 100 also includes control means 20, which are arranged to lock only one of these three main wheel sets, in order to couple differential mechanism 10, or to completely release frame 60 and first wheel set 1 and second wheel set 2 in order to uncouple differential mechanism 10, depending on the position given to control means 20 by a selector 30 comprised in transmission mechanism 100 and which is arranged to cooperate with an actuator comprised in a timepiece movement 500, and/or to be operated by a user, or to both cooperate with such an actuator and be operable by a user.

More particularly, these control means 20 are returned to a locking wheel set. This locking wheel set is whichever of the three main wheel sets on which differential mechanism 10 is locked in the coupling position, by elastic return means 40, which are arranged to exert engaging or friction torque on this locking wheel set, which is calibrated to allow a safety uncoupling function when the torque transmitted from one to the other of the other main wheel sets, which does not form this locking wheel set, is higher than the engaging or friction torque.

In a non-limiting embodiment illustrated by the Figures, this selector 30 includes at least one column wheel 31, which is arranged, according to its angular position, to modify the angular position of a lever 21 comprised in control means 20. This lever 21 includes a first beak 22, which is arranged to immobilise or release, depending on its position, a peripheral toothing comprised in the locking wheel set.

Advantageously, the locking wheel set includes an external toothing with wolf teeth, to allow a safety uncoupling function in one direction of rotation.

In particular, transmission mechanism 100 further includes mechanical locking means 50, which are arranged to be operated by an actuator comprised in a timepiece movement 500 and/or by a user, and which are arranged to lock these control means 20 in a coupled or uncoupled position.

In a particular, non-limiting embodiment, frame 60, first wheel set 1 and second wheel set 2 are arranged to pivot about axes parallel to a same differential direction.

In a variant, each planet wheel set 3 is arranged to pivot about an axis parallel to this differential direction.

In another variant, each planet wheel set 3 is arranged to pivot about an axis perpendicular to the differential direction.

In yet another variant, each planet wheel set 3 is arranged to pivot about an oblique and non-perpendicular axis with respect to the differential direction.

In a particular, non-limiting embodiment, this planet wheel set 3 is a planet pinion. In the particular case of FIG. 7, the planet wheel set is composed of a pinion and a wheel.

Figure 6:
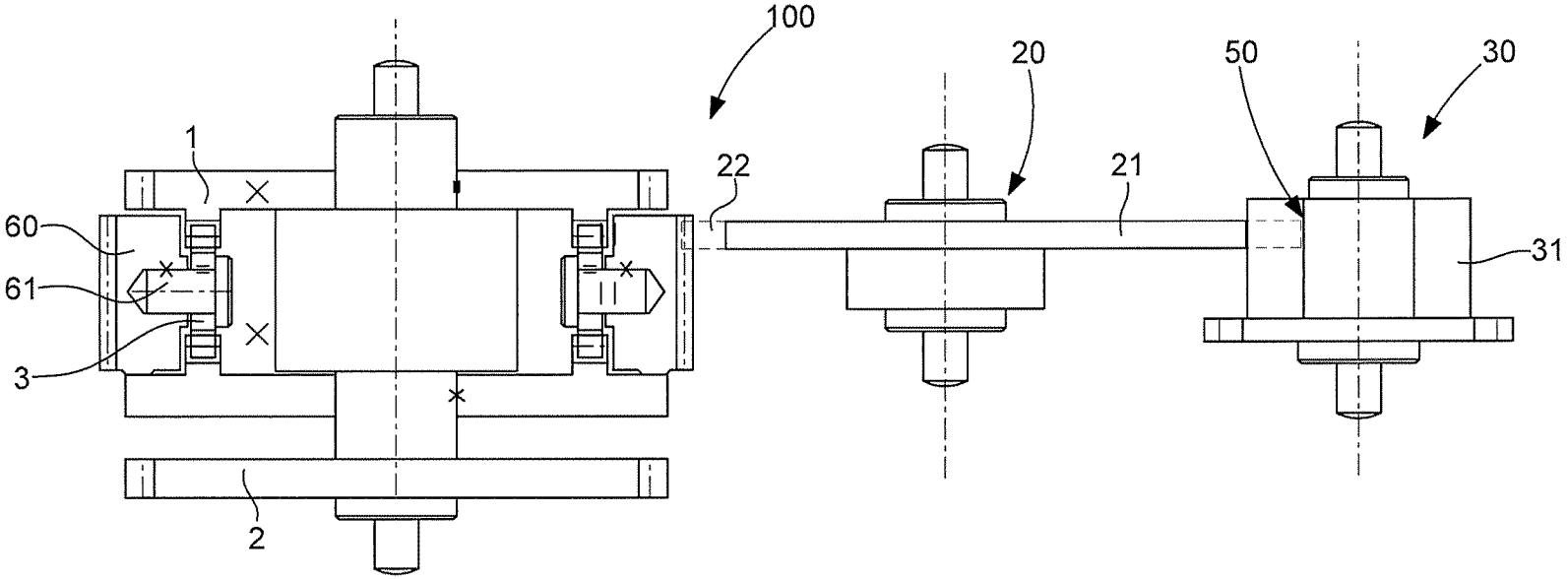
FIG. 6 represents a schematic cross-section, through the main contact points, of a single coupling mechanism with a spherical differential gear and frame locking.
Figure 7:
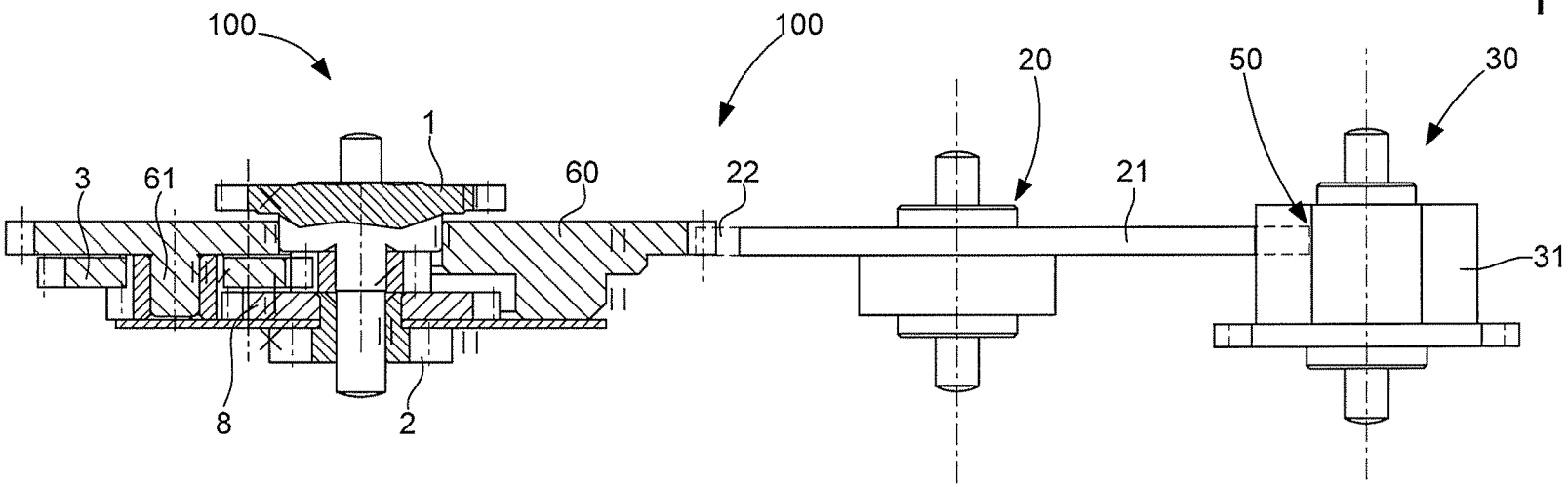
FIG. 7 represents a schematic cross-section, through the main contact points, of a single coupling mechanism with a differential with two sun gears and frame locking.

In a particular case, particularly in the embodiments illustrated by FIGS. 6 and 7, the locking wheel set, which is whichever of said three main wheel sets on which differential mechanism 10 is locked in the coupling position, is frame 60.

In a particular embodiment and as seen in the Figures, this frame 60 is a crown-wheel 6.

More particularly, the at least one planet wheel set 3, or each planet wheel set 3, is carried by first wheel set 1 or second wheel set 2 and permanently meshes with a toothing 4 of an arbor 5 integral at least in rotation with second wheel set 2 or respectively wheel set 1, and the at least one planet wheel 3, or each planet wheel 3, permanently meshes with said crown-wheel 6.

Figure 2:
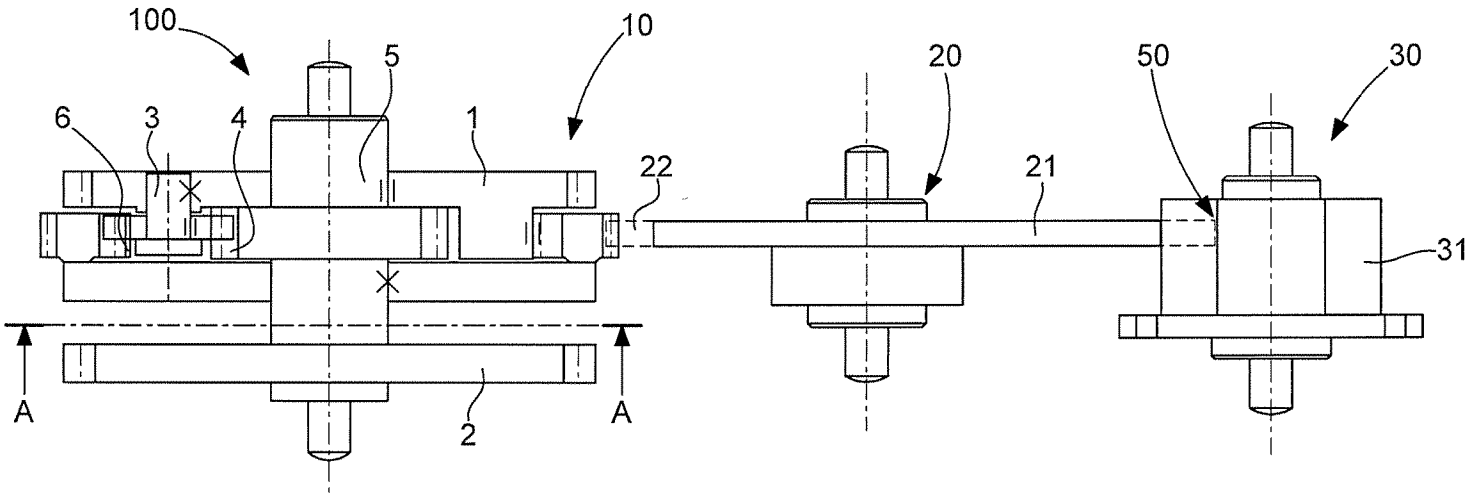
FIG. 2 represents a schematic cross-section of the mechanism of FIG. 1 through the main contact points.

More particularly still, as seen in FIGS. 1 and 2, this differential mechanism 10 includes at least one epicycloidal train, whose first wheel set 1 forms the planet carrier, second wheel set 2 forms the inner planet wheel, and whose crown-wheel 6 forms the outer planet wheel and is coaxial to second wheel set 2 and to first wheel set 1. Each planet wheel 3 of this epicycloidal train is confined between first wheel set 1 and second wheel set 2 or between first wheel set 1 and a frame 7 comprised in transmission mechanism 100, this frame is not represented to avoid overloading the Figure. In a particular case, this frame 7 is integral with second wheel set 2.

The use of a single differential system is not limiting. Indeed, a differential planetary gear and two crowns, a differential gear with two sun gears, a spherical or other differential gear can be used in a similar manner. The use of a crown-wheel for the locking function is not limiting; indeed, it may be advantageous, depending on the transmission ratios required, for the locking function to be performed on one or other input or output of one of these differential trains.

The principle of the invention can be applied to a differential mechanism 10 which includes several stages, and especially with each stage having an epicycloidal train.

More particularly, a dual coupling mechanism is commonly used in horology.

By combining two single coupling mechanisms according to FIG. 1, the following function can be obtained: coupling at output 1, neutral position and coupling at output 2. The neutral position is not mandatory. The two coupling mechanisms can be separately controlled.

Figure 3:
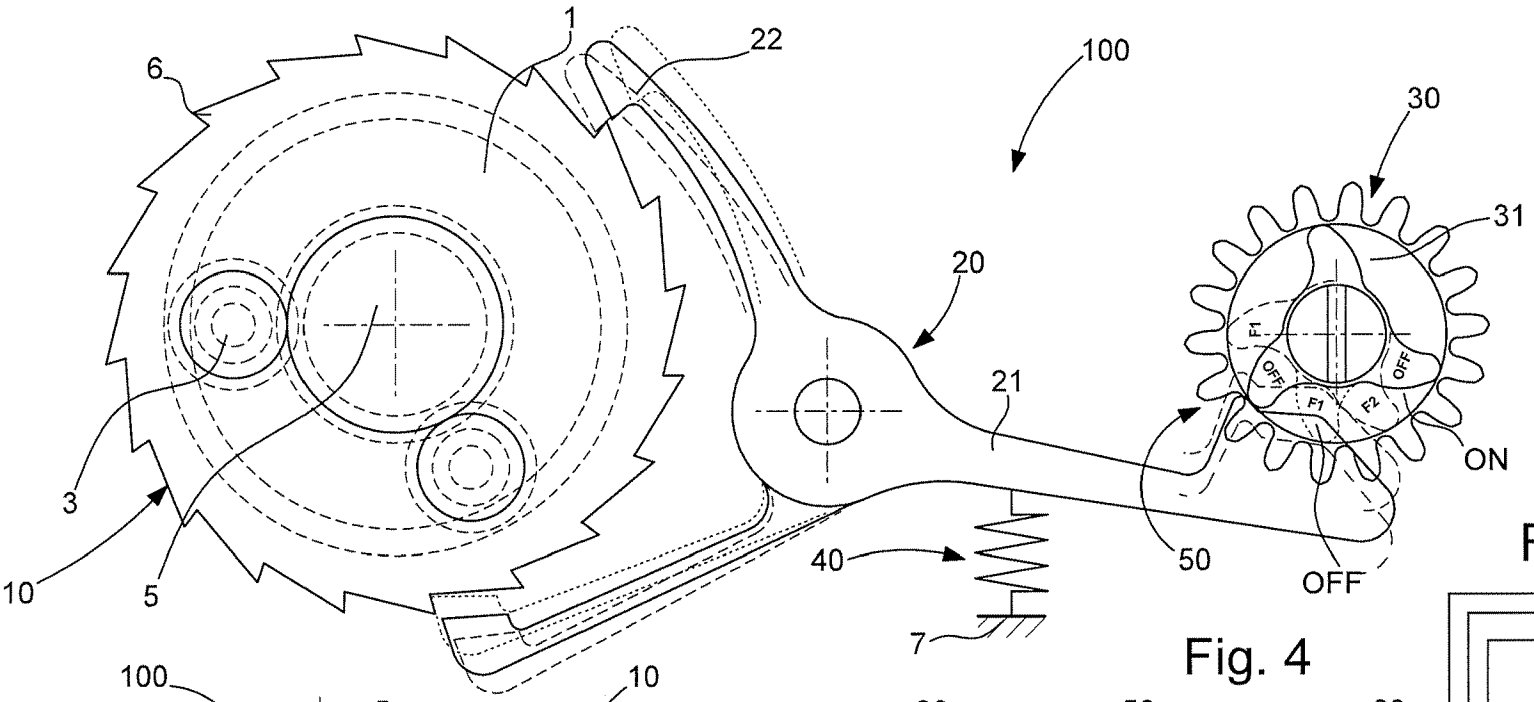
FIG. 3 represents a schematic, plan view of a dual coupling mechanism according to the invention.
Figure 5:
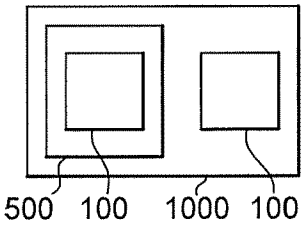
FIG. 5 is a block diagram representing a timepiece, notably a watch, including a movement 500 including such a transmission mechanism and further including another such transmission mechanism.
Figure 4:
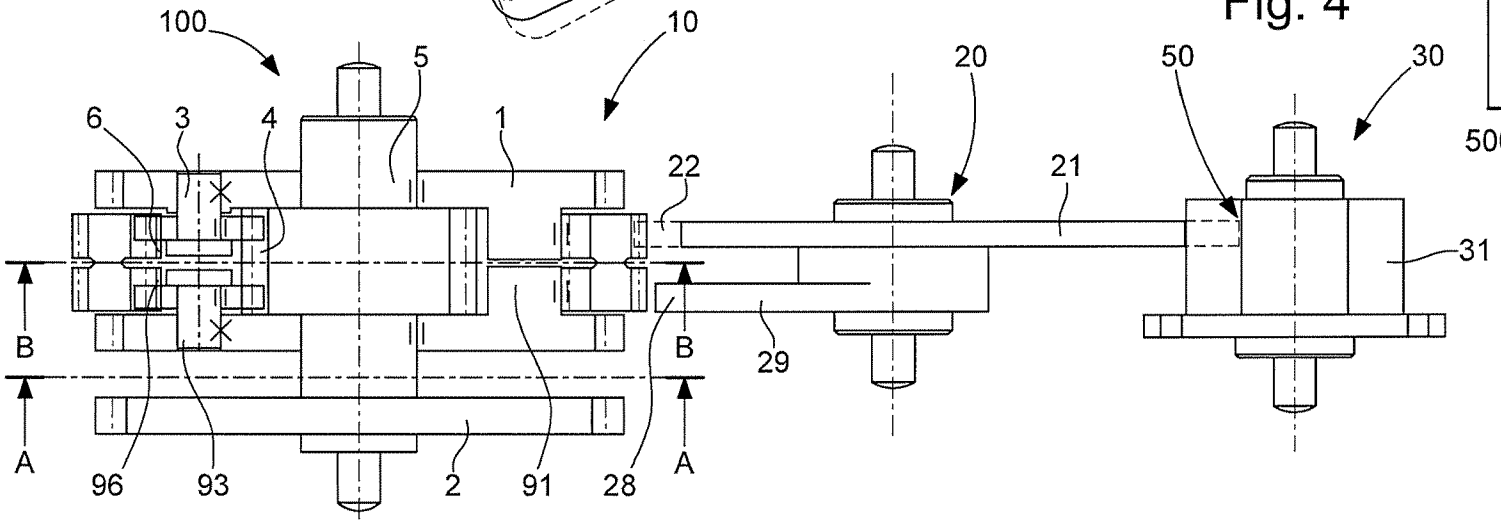
FIG. 4 represents a schematic cross-section, through the main contact points, of the mechanism of FIG. 3, which represents, in the top part, the view along AA of FIG. 4, and in the bottom part, the view along BB of FIG. 4.

FIGS. 3 and 4 illustrate such a dual coupling mechanism, with an additional epicycloidal train whose third wheel set 91 forms the planetary carrier, second wheel set 2 forms the inner planet wheel, and whose crown-wheel 96 forms the external planet wheel and is coaxial to second wheel set 2 and to a third wheel set 91, and whose secondary planet wheel 93 is confined between third wheel set 91 and frame 7. Control means 20 include a lever 21 which has a first beak 22 arranged to immobilise or release, depending on its position, a peripheral toothing comprised in the locking wheel set, and which includes a second arm 29 having a second beak 28 at its distal end.

In a particular embodiment and as illustrated by the Figures, at least one epicycloidal train, and more particularly each epicycloidal train, comprises only gear drive mechanisms.

In another particular embodiment, at least one epicycloidal train, and more particularly each epicycloidal train, includes at least one friction drive mechanism.

FIG. 6 illustrates a transmission mechanism 100, which includes a single coupling system with a spherical differential mechanism 10 and with frame locking, which includes such a frame 60 confined between a first wheel set 1 and a second wheel set 2, and which carries a hub for guiding the free rotation of each planet wheel 3 whose axis is perpendicular to a differential direction, to which the pivot axes of the three main wheel sets are parallel. Each planet wheel set 3 permanently meshes with first wheel set 1 and second wheel set 2.

FIG. 7 illustrates a transmission mechanism 100, which includes a single coupling system with a differential mechanism 10 with two sun gears and frame locking, which includes such a frame 60 confined between a first wheel set 1 and a second wheel set 2, and which includes a hub 61 for guiding the free rotation of each planet wheel 3 whose axis is parallel to a differential direction, to which the pivot axes of the three main wheel sets are parallel. Each planet wheel set 3 permanently meshes with an intermediate wheel set 8, which permanently meshes with one of the other two main wheel sets, or which is integral in rotation with one of the other two main wheel sets.

More particularly, differential mechanism 10 includes at least two inputs or outputs formed by a first wheel set 1 arranged to cooperate with a first train and a second wheel set 2 arranged to cooperate with a second train, differential mechanism 10 being able to kinematically connect first wheel set 1 and second wheel set 2 in a coupling position, and to kinematically separate them in an uncoupling position.

The invention thus includes a differential train whose two inputs serve to transmit rotation of the train, while the third input serves to couple and uncouple the transmission.

More particularly, and as seen in FIGS. 1 to 4, differential mechanism 10 includes at least one planet wheel set 3, which is carried by first wheel set 1, and which meshes permanently with a toothing 4 of an arbor 5 integral at least in rotation with second wheel set 2. This at least one planet wheel set 3 permanently meshes with a crown-wheel 6 forming another input or output of differential mechanism 10. Control means 20 are arranged here to lock crown-wheel 6 in order to couple differential mechanism 10, or to completely release crown-wheel 6 in order to uncouple differential mechanism 10, depending on the position given to control means 20 by such a selector 30.

When selector 30 and control means 20, which include, in a non-limiting manner in the particular embodiment illustrated by the Figures, a lever 21 having a first beak 22 at one end, lock the toothing of external crown-wheel 6 of the differential train via this first beak 22, the rotation applied to input 2 is transmitted to output 1.

When selector 30 and control means 20 unlock the toothing of external crown-wheel 6 of the differential train, the rotation applied to input 2 is transmitted to differential crown-wheel 6 which is no longer locked and can then rotate freely and stop the transmission of torque to output 1.

In this non-limiting example, this on/off function is controlled by a selector 30 which includes at least one column wheel 31 arranged, depending on its angular position, to modify the angular position of lever 21 comprised in control means 20. Other alternative control means can be used, such as a shuttle, lever or otherwise.

In the embodiment illustrated by FIGS. 1 and 3, the locking function is achieved indirectly by elastic return means 40, in the form of a control spring connected here to a frame 7, or to a plate, bridge or suchlike, which offers the possibility of a safety uncoupling function if the transmitted torque becomes higher than the torque of the teeth of crown-wheel 6 on the control device. Thus, control means 20 are returned to crown-wheel 6, in order to couple differential mechanism 10, by elastic return means 40 arranged to exert on crown-wheel 6 an engaging or friction torque, which is calibrated to allow a safety uncoupling function when the torque transmitted from wheel set 1 to wheel set 2, or vice versa, is higher than the engaging or friction torque.

In an advantageous variant and as seen in FIG. 3, crown-wheel 6 includes an external toothing with wolf teeth in order to allow a safety uncoupling function in one direction of rotation.

The invention also concerns a timepiece movement 500 including at least one such transmission mechanism 100.

The invention also concerns a timepiece 1000, in particular a watch, including at least one such movement 500 and/or at including least one such transmission mechanism 100.

In short, the invention constitutes an alternative solution to already known solutions and has the advantage of limiting the number of components that move to perform the coupling and uncoupling function, in particular in comparison to the clamps of vertical coupling systems.

The invention makes it possible to limit the stresses (forces and/or torques) required to perform the coupling and uncoupling functions.

The invention can be sized to ensure transmission of a higher torque, especially in the case of a vertical chronograph coupling structure where the torque is provided by a friction spring.

The invention makes it possible to make single coupling mechanisms like the on/off chronograph coupling and dual coupling mechanisms such as winding and time setting mechanism: function 1/function 2.

The invention also allows a threshold torque to be calculated with a safety uncoupling function.

The invention claimed is:

1. A timepiece transmission mechanism, arranged to be integrated in a timepiece movement and comprising at least one differential mechanism including at least one planet wheel set mounted for free rotation and at least three main wheel sets forming the inputs or outputs of said differential mechanism, which three main wheel sets are formed by a frame, a first wheel set arranged to cooperate with a first train, and a second wheel set arranged to cooperate with a second train, only one of said three main wheel sets carrying at least one said planet wheel set permanently meshing with the other two main wheel sets, either directly or through at least one intermediate wheel set which permanently meshes with one of said other two main wheel sets or which is integral in rotation with one of said other two main wheel sets, said differential mechanism being able to kinematically connect said first wheel set and said second wheel set in a coupling position, and to separate them kinematically in an uncoupling position, said transmission mechanism further comprising control means arranged to lock only one of said three main wheel sets in order to couple said differential mechanism, or to completely release said frame and said first wheel set and said second wheel set in order to uncouple said differential mechanism, depending on the position given to said control means by a selector comprised in said transmission mechanism and which is arranged to cooperate with an actuator comprised in said timepiece movement, and/or to be operated by a user, and wherein said control means are returned to a locking wheel set which is whichever of said three main wheel sets on which said differential mechanism is locked in the coupling position, by elastic return means, arranged to exert on said locking wheel set an engaging or friction torque, which is calibrated to allow a safety uncoupling function when the torque transmitted from one to the other of the other main wheel sets distinct from said locking wheel set is higher than said engaging or friction torque, wherein said locking wheel set includes an external toothing with wolf teeth, to allow a safety uncoupling function in one direction of rotation.

2. The transmission mechanism according to claim 1, wherein said selector comprises at least one column wheel, which is arranged, according to its angular position, to modify the angular position of a lever comprised in said control means, which lever includes a first beak arranged to immobilise or release, depending on its position, a peripheral toothing comprised in said locking wheel set.

3. The transmission mechanism according to claim 1, wherein said transmission mechanism further comprises mechanical locking means arranged to be operated by an actuator comprised in said timepiece movement and/or by a user, and which are arranged to lock said control means in a coupled or uncoupled position.

4. The transmission mechanism according to claim 1, wherein said frame, said first wheel set and said second wheel set are arranged to pivot about axes parallel to a same differential direction.

5. The transmission mechanism according to claim 4, wherein each said planet wheel set is arranged to pivot about an axis parallel to said differential direction.

6. The transmission mechanism according to claim 4, wherein each said planet wheel set is arranged to pivot about an axis perpendicular to said differential direction.

7. The transmission mechanism according to claim 4, wherein each planet wheel set is arranged to pivot about an oblique and non-perpendicular axis with respect to said differential direction.

8. The transmission mechanism according to claim 1, wherein the locking wheel set is whichever of said three main wheel sets on which said differential mechanism is locked in the coupling position, is said frame.

9. The transmission mechanism according to claim 1, wherein said frame is a crown-wheel.

10. The transmission mechanism according to claim 9, wherein said at least one planet wheel set is carried by said first wheel set or said second wheel set and permanently meshes with a toothing of an arbor integral at least in rotation with said second wheel set or respectively with said first wheel set, and said at least one planet wheel set permanently meshes with said crown-wheel.

11. The transmission mechanism according to claim 10, wherein said differential mechanism comprises at least one epicycloidal train wherein said first wheel set forms the planetary carrier, said second wheel set forms the inner planet wheel, and said crown-wheel forms the external planet wheel and is coaxial to said second wheel set and to said first wheel set, and wherein each said planet wheel is confined between said first wheel set and said second wheel set or between said first wheel set and a frame comprised in said transmission mechanism.

12. The transmission mechanism according to claim 11, wherein said frame is integral with said second wheel set.

13. The transmission mechanism according to claim 11, wherein said differential mechanism comprises a dual coupling system, with an additional epicycloidal train wherein a third wheel set forms the planetary carrier, said second wheel set forms the inner planet wheel, and wherein a crown-wheel forms the external planet wheel and is coaxial to said first wheel set and to a third wheel set, and wherein each secondary planet wheel is confined between said third wheel set and said frame, and wherein said control means include a lever which includes a first beak arranged to immobilise or release, depending on its position, a peripheral toothing comprised in said locking wheel set, and which includes a second arm including a second beak at its distal end.

14. The transmission mechanism according to claim 11, wherein each said epicycloidal train includes only gear drive mechanisms.

15. The transmission mechanism according to claim 11, wherein at least one said epicycloidal train includes at least one friction drive mechanism.

16. The transmission mechanism according to claim 1, wherein said differential mechanism comprises several levels each having an epicycloidal train.

17. The transmission mechanism according to claim 1, wherein said transmission mechanism comprises a single coupling system with a spherical differential mechanism, and with frame locking, which includes said frame confined between said first wheel set and said second wheel set, and which carries a hub for guiding the free rotation of each said planet wheel set whose axis is perpendicular to a differential direction to which are parallel the pivot axes of said three main wheel sets, each said planet wheel set permanently meshing with said first wheel set and with said second wheel set.

18. The transmission mechanism according to claim 1, wherein said transmission mechanism comprises a single coupling system with a differential mechanism having two sun gears, and with frame locking, which includes said frame confined between said first wheel set and said second wheel set, and which carries a hub for guiding the free rotation of each said planet wheel set whose axis is parallel to a differential direction to which are parallel the pivot axes of said three main wheel sets, each said planet wheel set permanently meshing with said intermediate wheel set which permanent meshes with one of said other two main wheel sets, or which is integral in rotation with one of said other two main wheel sets.

19. A timepiece movement comprising at least one transmission mechanism according to claim 1.

20. The timepiece comprising at least one movement according to claim 19 and/or including at least one transmission mechanism.

* * * * *